United States Patent [19]

Gulistan

[11] Patent Number: 4,843,927

[45] Date of Patent: Jul. 4, 1989

[54] LOCKING FASTENER FOR PIVOTAL TOOL

[76] Inventor: Bulent Gulistan, 20568 Pinnacle Way, Malibu, Calif. 90265

[21] Appl. No.: 149,570

[22] Filed: Jan. 28, 1988

[51] Int. Cl.[4] ..... B25B 7/06

[52] U.S. Cl. ..... 81/416; 81/415

[58] Field of Search ..... 81/416, 417, 415; 411/21, 22, 226, 344

[56] References Cited

U.S. PATENT DOCUMENTS

| | | | |
|---|---|---|---|
| 2,083,483 | 6/1937 | Strezoff | 81/416 |
| 2,704,399 | 3/1955 | Melcher | 81/416 |
| 4,636,121 | 1/1987 | Miller | 411/21 |

*Primary Examiner*—Frederick R. Schmidt
*Assistant Examiner*—Lawrence Cruz
*Attorney, Agent, or Firm*—Poms, Smith, Lande & Rose

[57] ABSTRACT

Locking fasteners for pivotal tools which will not loosen during use and which apply a constant pressure between pivotal tool members. A pivot screw is provided with a holow inner bore in which a securing screw is inserted to cause binding engagement with a portion of the wall formed by the opening in which the pivot screw is inserted. In one embodiment, the securing screw causes expansion of the pivot screw shaft. In another, the securing screw actuates a compressible member which engages the wall. In the event of looseness between the two pivotal parts as a result of shock or for any other reason, the securing screw may be actuated to permit tightening or readjustment of the pivot screw.

5 Claims, 1 Drawing Sheet

FIG. 1
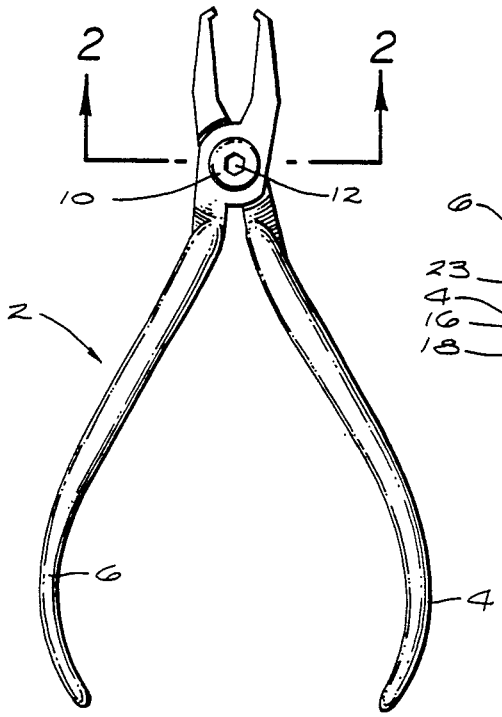
FIG. 2
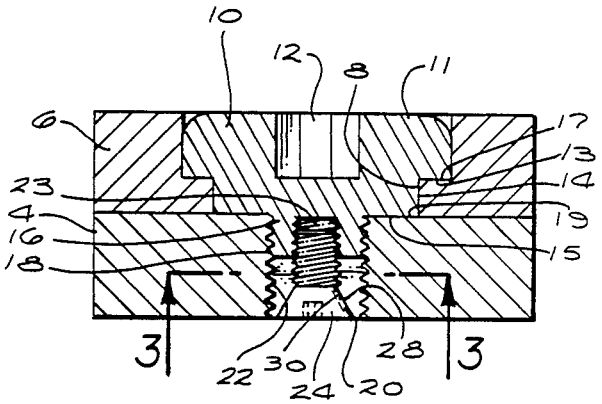
FIG. 3
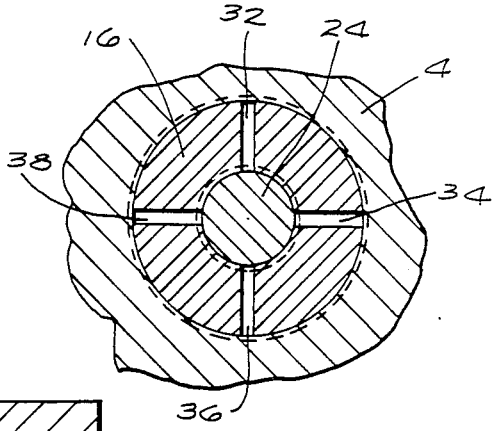
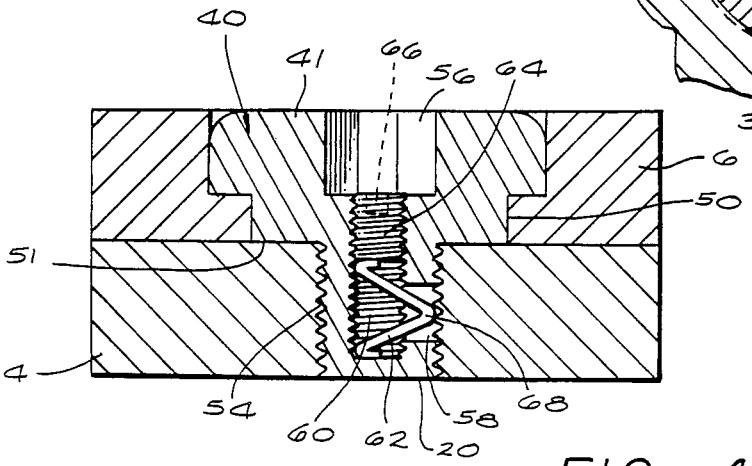
FIG. 4

LOCKING FASTENER FOR PIVOTAL TOOL

FIELD OF THE INVENTION

This invention relates to precision tools having pivotal members and, more specifically, to arrangements for easily fastening such pivotal members to one another and in such a manner that the fastening means will not come loose during use.

BACKGROUND OF THE INVENTION

Several types of useful precision tools and instruments consist of a plurality of elongated members pivotally fastened together at a point close to one end of the elongated members. Typical examples include dental pliers, scissors, cutters, and a broad variety of other precision tools used in several fields, including medicine, dentistry and instrumentation.

Typically, the pivotal members of the tool are pivotally affixed to one another with a threaded screw. Unfortunately, such fastening means often loosens during use, reducing the effectiveness of the tool. Further, when an expensive precision tool has a worn fastener, such that it cannot be tightened to provide precision mating of the jaws, the tool must often be replaced at considerable expense, with some dental tools costing between 50 and 100 dollars.

One way of avoiding this problem is to use a rivet in place of the screw. This solution is not entirely satisfactory, however, because it is difficult to control the precise binding pressure on the pivotal joint. In addition, the stresses placed upon the rivet during use often cause it to deform, similarly causing loosening of the pivotal members and an associated loss in tool effectiveness. Unlike the threaded screw, moreover, it is difficult to again increase the attachment force once deformation of the rivet has occurred. A rivet also makes it difficult to detach the tool members for cleaning, sharpening or replacement.

Another problem with existing fasteners for pivotal tools appears in the assembly process. Specifically, it is often desirable that the pressure asserted by the fastening means be relatively the same for each tool. In practice, this requires testing and readjustment during the assembly process. Not only does this increase the complexity of tool assembly, but also the difficulties a user may encounter when he must retighten the fastening means after some use.

In short, there has been a continuing need for a fastener for pivotal tool members which will not come loose during normal use, which consistently achieves the desired attachment force, and which may be readily reset to the proper tightness in case of looseness resulting from any occurrence.

SUMMARY OF THE INVENTION

One object of the present invention is to solve these and other problems in the prior art.

Another object of the present invention is to provide a fastening means for pivotal tool members which will not come loose during use.

A still further object of the present invention is to provide a fastening means for pivotal tool members which consistently applies the desired pressure without testing.

A still further object of the present invention is to provide a fastening means for pivotal tool members which is easy to implement and use. A still further object of the present invention is to provide a fastening means for pivotal tool members which can easily be disassembled without damage or injury to the pivotal tool.

A still further object of the present invention is to provide a fastening means for pivotal tool members which can be disassembled to allow for cleaning, sharpening or replacement of the tool members.

These and other objects of the present invention are achieved through the use of a pivot screw having means for bindingly engaging the inner wall of the opening in which the pivot screw is inserted. A shoulder on the shaft of the pivot screw limits the pressure that can be asserted by the pivot screw on the joint between the pivotal tool members.

A small securing screw is advantageously used to actuate the binding engagement means.

In one embodiment, the securing screw is inserted or threaded into a bore in the shaft of the pivot screw. It has a tapered head which causes the end of the shaft to expand and bindingly engage the wall of the bore in which the shaft of the pivot screw has been inserted or threaded. To facilitate expansion of the screw shaft, it may be axially slotted.

In another embodiment, the securing screw is also inserted or threaded into a bore in the shaft of the pivot screw. In this embodiment, however, such insertion causes compression of a compressible member which, in turn, causes protrusion of the compressible member through a window in the bore of the pivot screw. This protrusion, in turn, causes the compressible member to bindingly engage the wall in which the pivot screw has been inserted or threaded. This similarly locks the pivot screw in place.

These and other features and objects of the present invention will now become apparent from a review of the drawings and the following description of the preferred embodiments.

BRIEF DESCRIPTION OF THE DRAWINGS

FIG. 1 is a top view of a pivotal tool incorporating the present invention.

FIG. 2 is a cross-sectional view taken along the line 2—2 of FIG. 1. It illustrates the structure of one preferred embodiment of the present invention.

FIG. 3 is a cross-sectional view of FIG. 2 taken along line 3—3 of FIG. 2. It illustrates further details of the preferred embodiment of the present invention.

FIG. 4 is a cross-sectional view of an alternative embodiment of the present invention.

DETAILED DESCRIPTION

FIG. 1 is a top view of a pivotal dental tool 2. It includes tool members 4 and 6 pivotally joined near one end thereof by a pivot screw 10.

The pivotal tool 2 is, in fact, a dental tool. However, as will now become readily apparent, the present invention is applicable to all types of precision tools having pivotally-joined members, including pliers, scissors, cutters, and other types of medical tools, instrumentation tools and the like. The selection of a dental tool is for illustration purposes only.

FIG. 2 is a cross-sectional view of FIG. 1 taken along line 2—2. It illustrates important details of one preferred embodiment of the present invention.

Specifically, FIG. 2 shows the pivotally mounted tool members 4 and 6 being held together by the pivot screw 10. The pivot screw 10 includes a head 11 which has a circular shoulder 13 in contact with a portion of an upper surface 17 of the tool member 6.

The pivot screw 10 further includes an upper shank portion 14 which is slidably engaged with an opening 8 in the tool member 6.

The pivot screw 10 further includes a circular shoulder 15 at the lower end of the upper shank portion 14 which engages the circular upper surface 19 on the tool member 4.

The pivot screw 10 further includes a lower threaded portions 16 which includes threads 18 in engagement with threads 22 present in the internally threaded opening 20 in the lower pivotally mounted tool member 4.

The pivot screw 10 further includes a hollow internal bore 23 in the end of the lower threaded portion 16. Within the inner bore 23 is a small securing screw 24 which has an inwardly tapered surface 28 which bears on a mating outwardly tapered surface 30 present at the opening at the lower end of the pivot screw 30.

FIG. 3 is a cross-sectional view of FIG. 2 taken along line 3—3. As best shown in FIG. 3, the end of the inner shaft 16 has been slotted along its longitudinal axis so as to contain longitudinal slots 32, 34, 36 and 38, to free the intermediate remaining portions of the screw for outward deformation.

To assemble the tool members 4 and 6 with the fastener shown in FIGS. 2 and 3, the pivot screw 10 is inserted in the opening 8 of tool member 6 and is then threaded into the opening 20 in the lower tool member 4. An Allen wrench is inserted into an Allen head recess 12 contained in the head 11 of the pivot screw 10 and is torqued, causing the pivot screw 10 to be screwed into the mating threads 22 contained within the opening 20 of the tool member 4.

As will be seen by a close examination of FIG. 2, the shoulder 15 on the pivot screw 10 will engage the upper surface 19 of the lower tool member 4 at some point while the pivot screw 10 is being screwed into the matting threads 22. Once this occurs, the pivot screw 10 cannot be screwed any further into the mating threads 22.

The force which is applied between the upper tool member 6 and the lower tool member 4 is primarily a function of the length of the upper shank portion 14 of screw 10. In the preferred embodiment, this length is made substantially equal to the thickness of the upper tool member 6 immediately adjacent the pivotal opening. Of course, the circular shoulder 13 under the head 11 must also extend beyond the opening 8 in the upper tool member 6, as shown in FIG. 2. The fastener 10 will be fixed to the lower pivotal number 4, and the fastener 10 must therefore have relatively close tolerances with the pivotal member 6 so that the member 6 may rotate, but with no looseness or play.

After the pivot screw 10 is torqued in place, the securing screw 24 is screwed in the inner threaded bore 23 contained within the lower portion of the lower shaft 16. Incidentally, it could have been loosely screwed in place prior to the threading of the pivot screw 10 into the threaded opening 20, if desired.

As can best be seen in FIG. 2, once the tapered surface 28 on the small securing screw 24 engages the tapered surface 30, further torquing of the screw 24 will cause the lower portions of lower shaft 16 to expand and engage the bore 20 in the lower tool member 4. Once this occurs, the pivot screw 10 will not readily disengage, even though torque forces will be applied to it as the tool members 4 and 6 of pivotal tool 2 are moved together and apart during use.

Although having thus discussed one embodiment, the present invention is applicable to a broad spectrum of embodiments.

For example, the slots contained within the lower shaft 16 of the pivot screw 10 could be different in number or shape from the longitudinal slots discussed above. If the material of the inner shaft 16 is sufficiently flexible, using a suitable plastic for example, the expansion effect caused by securing screw 24 could even occur within the scope of the present invention without any slots. However, the use of a metal screw and slots is preferred.

Although this preferred embodiment has been shown with threading engagement between the pivot screw 10 and the lower tool member 4, the present invention also contemplates that the lower portion of the lower shaft 16 could achieve engagement with the opening 20 without mating threads, but solely by virtue of the expansion effect of the securing screw 24 on the lower portion of the lower shaft 16. In this case, however, an outward taper on the opening where the threads 18 are located would be desirable. Similarly, although the securing screw 24 is shown to be threadably engaged with the lower shaft 16, such engagement could also be effectuated within the scope of the present invention without threads by using an unthreaded elongated member driven into bore 23. In this case, it would be preferable if the diameter of the unthreaded elongated member were gradually widened along its entire length, rather than merely at its head as shown in FIG. 2, and a roughened interface for increased friction be employed along the mating surfaces.

FIG. 4 is a cross-sectional view of an alternative embodiment of the present invention.

As can be seen in FIG. 4, this alternate embodiment includes a pivot screw 40 having an upper shank portion 50, a circular shoulder 51 beneath the upper portion, and a lower threaded shaft 54. Thus far, the structure of the pivot screw 40 is the same as the structure of the pivot screw 10 illustrated in FIG. 2, and its dimensions are governed by the same considerations as were discussed above with respect to the pivot screw 10.

The pivot screw 40 similarly has an Allen head recess 56. Unlike the pivot screw 10, however, it further includes a central internally threaded bore 60 extending through its head 41 and into the smaller diameter threaded shaft 54, but not through the end of the smaller shaft 54. It further includes an open window 58 extending from the inner bore 60 to the outer surface of threaded number 54, a compressible member 62 (preferably made of an elongated, strong and compressible material such as steel) and a set screw 64.

The pivot screw 40 is screwed into the tool members 4 and 6 in the same fashion and with the same considerations as was discussed above with respect to the pivot screw 10 shown in FIGS. 2 and 3. Once the pivot screw 40 is firmly torqued in place, however, different arrangements are used to prevent disengagement.

Specifically, the compressible member 62 is inserted into the inner bore 60. Thereafter, the set screw 64 is screwed into the threaded inner bore 60 by applying torque with an Allen wrench to its Allen head recess 66. Once the set screw 64 reaches the compressible member 62, it is further torqued to cause the compressible member 62 to bulge and to protrude outwardly from the window 58 and into binding engagement with the internal threads of the opening 20 in the lower pivotally mounted tool member 4.

To ensure deformation of the compressible member 62 in the direction and at the point of the window 58, the compressible member 62 is preferably deformed before insertion into bore 60 such that it has a protruding portion 68 which protrudes slightly into the window 58, even without torquing of the set screw 64.

The pivot screws 10 and 40 can be made of a variety of materials, as is well known in the art. In the preferred embodiment, they are made of stainless steel.

Similarly, the securing screw 24 and set screw 64 can also be made from a variety of materials. In the preferred embodiments, they are also made of steel.

It is again noted that, if the pivot screw 11 of FIG. 2 or 41 of FIG. 4 should ever need adjustment, then the set screw 23 of FIG. 2 or the set screw 64 of FIG. 4 would be loosened, the pivot screw would be adjusted, and then the set screw re-tightened, locking the pivot screw in its readjusted position.

Having thus described exemplary embodiments of the present invention, it should be noted by those skilled in the art that the within disclosures are exemplary only and that various other alternatives, adaptations and modifications may be made within the scope of the present invention. Accordingly, the present invention is not limited to the specific embodiments described and/or illustrated herein, but only by the following claims.

What is claimed is:

1. A precision tool for dental, medical, instrumentation or the like having pivotally mounted jaws, said tool comprising:

first and second members having handle portions at one of their ends and cooperating jaws at their other ends;

said members having aligned openings about which the first and second members pivot;

the aligned opening in said first member being threaded;

the aligned opening in said second member being stepped with a lesser diameter opening adjacent said first member, and said lesser diameter opening having a diameter substantially greater than the threaded opening in said first member;

stepped screw means having dimensions which mate with dimensions of the openings in said two members for pivotally attaching said two members together, said screw means being threaded into the threaded opening in said first member, and making a close tolerance fit with the stepped recess in said second member;

said stepped screw having smaller diameter unthreaded portion having a circular cross-section perpendicular to the central axis of said stepped screw;

locking means for locking said stepped screw means to said first fastener by inter-engagement between said stepped screw means and the internal threads of the threaded opening in said first member;

said stepped screw means having a first shoulder portion firmly engaging said first member so that said screw means rotates with said first member, and siad stepped screw means having a second shoulder making a close tolerance fit with said second member; and the threaded end of said stepped screw means having an internally threaded coaxial bore, and a window extending from the internally threaded bore to the outer threaded surface of said screw means, said locking means being expandible and extending through said window bindingly engage the internal threads on said first member, and set screw means for engaging and actuating said locking means when said set screw means is tightened into said internally threaded bore;

whereby said tool may be assembled by screwing said stepped screw means in firmly to full depth, and then engaging said locking means.

2. A locking pivotal tool fastener for pivotally fastening tool members to one another, each of the tool members having an opening therein, comprising:

a. pivot screw means for pivotally affixing the tool members to one another by insertion through the openings in the tool members, said pivot screw means having a shaft portion and a head portion fixed to said shaft portion;

b. binding engagement means connected to said shaft portion for preventing said pivot screw means from disengaging from one of the openings by bindingly engaging a portion of the wall chamber formed by one of the openings;

c. actuation means connected to said binding engagement means for causing said binding engagement means to bindingly engage the portion of the wall chamber formed by one of the openings;

d. said pivot screw means having first and second shoulders and having thread means at one end for engaging mating threads in a first one of said tool members, with said first shoulder firmly engaging said first one of said tool members;

e. the other of said tool members having a stepped recess therein, and said second shoulder of said pivot screw means making a close tolerance fit with said stepped recess when said pivot screw is tightened so that said first shoulder firmly engages said first one of said tool members; and f. said binding engagement means including a hollow inner bore in said shaft portion, a window in said shaft portion, and an elongated and compressible member inserted in said hollow inner bore and having a portion which protrudes from said window upon compression.

3. The fastener of claim 2 wherein said actuation means is a set screw.

4. The fastener of claim 3 wherein said fastener further includes pressure limit means for limiting the amount of pressure which said pivot screw can cause to be asserted between the tool members.

5. The fastener of claim 4 wherein said pressure limit means includes upper and lower shaft portions and a shoulder on the bottom of said upper shaft portion.

* * * * *